US007445254B2

(12) United States Patent
Etlicher

(10) Patent No.: US 7,445,254 B2
(45) Date of Patent: Nov. 4, 2008

(54) DUAL DEAD BOLT LATCH

(75) Inventor: Peter Etlicher, Rice Lake, WI (US)

(73) Assignee: Truth Hardware Corporation, Owatonna, MI (US)

( * ) Notice: Subject to any disclaimer, the term of this patent is extended or adjusted under 35 U.S.C. 154(b) by 173 days.

(21) Appl. No.: 11/119,348

(22) Filed: Apr. 29, 2005

(65) Prior Publication Data

US 2006/0243008 A1 Nov. 2, 2006

(51) Int. Cl.
*E05C 1/06* (2006.01)

(52) U.S. Cl. ..... 292/34; 292/156; 292/143; 292/140

(58) Field of Classification Search ..... 292/34, 292/33, 22, 35, 36, 42, 156 X, 157, 158, 162, 292/137, 163, 169, 173, 138, 140 X, 143 X, 292/146, 150, 302; 70/107–111
See application file for complete search history.

(56) References Cited

U.S. PATENT DOCUMENTS

| | | | | |
|---|---|---|---|---|
| 446,101 | A | 2/1891 | Ludwig | |
| 1,041,388 | A | 10/1912 | Wegmann | |
| 1,346,143 | A * | 7/1920 | Teich | 70/108 |
| 2,028,672 | A | 1/1936 | Kubina | |
| 2,179,352 | A | 11/1939 | Rightmyer | |
| 2,189,405 | A | 2/1940 | Rightmyer | |
| 3,477,755 | A | 11/1969 | Russell et al. | |
| 4,665,727 | A * | 5/1987 | Uyeda | 70/279.1 |
| 5,044,184 | A | 9/1991 | Herbers et al. | |
| 5,083,448 | A | 1/1992 | Karkkainen et al. | |
| 5,096,238 | A * | 3/1992 | Mintz | 292/35 |
| 5,341,752 | A * | 8/1994 | Hambleton | 109/59 R |
| 5,595,408 | A * | 1/1997 | Jeche | 292/37 |
| 5,673,948 | A | 10/1997 | Karpisek | |
| 5,878,606 | A * | 3/1999 | Chaput et al. | 70/108 |
| 6,622,535 | B2 | 9/2003 | Chiang et al. | |

FOREIGN PATENT DOCUMENTS

| | | |
|---|---|---|
| DE | 3400618 | 7/1985 |
| GB | 2143888 A * | 2/1985 |

* cited by examiner

*Primary Examiner*—Patricia Engle
*Assistant Examiner*—Mark Williams
(74) *Attorney, Agent, or Firm*—Perman & Green, LLP

(57) ABSTRACT

A latch apparatus includes a live bolt actuated between an extended position and a retracted position, first and second dead bolts, and a slide. The first dead bolt is positioned vertically above the live bolt and the second dead bolt is positioned vertically below the live bolt. The first and second dead bolts have substantially the same size and shape and are spaced equidistant from the live bolt. The slide couples the first and second dead bolts to each other, wherein vertical movement of the slide simultaneously actuates the first and second dead bolts between extended and retracted positions.

19 Claims, 7 Drawing Sheets

DUAL DEAD BOLT LATCH

BACKGROUND OF THE INVENTION

1. Field of the Invention

The present invention is directed to a latch apparatus, and in particular to a latch having at least two symmetrically arranged dead bolts and related methods of assembling door assemblies that include the latch.

2. Related Art

Mortise door latches that include dead and live bolts are typically constructed for use in a particular orientation within a door mortise. This orientation corresponds to the arrangement of the dead and live bolts relative to openings in the door frame formed for the dead and live bolts. A given mortise door latch may be reversible for use in right or left hand doors. Such a reversal may require flipping the latch upside down in the mortise and reversing the live bolt in the housing of the latch. The reversibility of a mortise door latch in this way makes it possible to have less stock as compared to the amount of stock required if separate left and right hand latches were required for left and right hand doors.

Due to this reversible mounting of mortise door latches for right and left hand doors, and the common practice in the door industry to manufacture doors that can be used as either left or right hand doors, mortise latches are typically installed by the person installing the door in a building. Many door installers are homeowners who experience at least some difficulty installing door latches.

A door latch that addresses these and other known disadvantages in the latch and door industries would be an important advance in the art.

SUMMARY OF THE INVENTION

The present invention generally relates to a mortise door latches and door assemblies that include mortise door latches. One aspect of the invention relates to a latch apparatus that includes a live bolt actuated between an extended position and a retracted position, first and second dead bolts, and a slide. The first dead bolt is positioned vertically above the live bolt and the second dead bolt is positioned vertically below the live bolt. The first and second dead bolts have substantially the same size and shape and are spaced equidistant from the live bolt. The slide couples the first and second dead bolts to each other, wherein vertical movement of the slide simultaneously actuates the first and second dead bolts between extended and retracted positions.

Another aspect of the invention relates to a latch apparatus that includes a housing, a live bolt, first and second dead bolts, a slide, and a hub member. The live bolt is mounted within the housing and actuated between an extended and a retracted position. The first and second dead bolts are mounted at least partially within the housing at equally spaced apart positions on opposing sides of the live bolt and movable between retracted and extended positions. The slide is mounted within the housing and couples the first and second dead bolts to each other. The hub member is rotatably mounted within the housing and coupled to the slide. Rotating the hub member moves the slide, thereby extending and retracting the first and second dead bolts.

A further aspect of the invention relates to a door that includes a door panel, a handle, and a latch apparatus that includes a live bolt, first and second dead bolts, and a slide. The door panel includes a mortise formed in a face thereof and a bore extending between opposed side surfaces thereof. The handle includes a locking mechanism. The latch apparatus is disposed in the mortise. The live bolt is movable between extended and retracted positions. The first and second dead bolts are positioned at opposing sides of the live bolt and movable between extended and retracted positions. The slide is coupled to the first and second dead bolts and to the locking mechanism, wherein the locking mechanism actuates the slide to extend and retract the first and second dead bolts.

A still further aspect of the invention relates to a method of assembling a door assembly that includes a door panel and a latch apparatus. The door panel includes a face, opposed side surfaces, and first and second ends. The latch apparatus includes a housing, a live bolt, and a pair of dead bolts. The method includes forming a mortise in the door panel face equidistant from the first and second ends, and assembling the latch apparatus with the live bolt and the dead bolts in the housing. The dead bolts are spaced apart it the housing equidistant vertically above and below the live bolt, and the live bolt and dead bolts are actuated between extended and retracted positions. The method also includes positioning the latch apparatus in the mortise to form the door assembly. The door assembly is reversible for use as a left hand door or a right hand door without altering a position of the latch apparatus in the mortise.

These features of novelty and various other advantages that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

The invention may be more completely understood in consideration of the following detailed description of various embodiments of the invention in connection with the accompanying drawings, wherein like numerals represent like parts throughout several views, in which.

Figure 1:
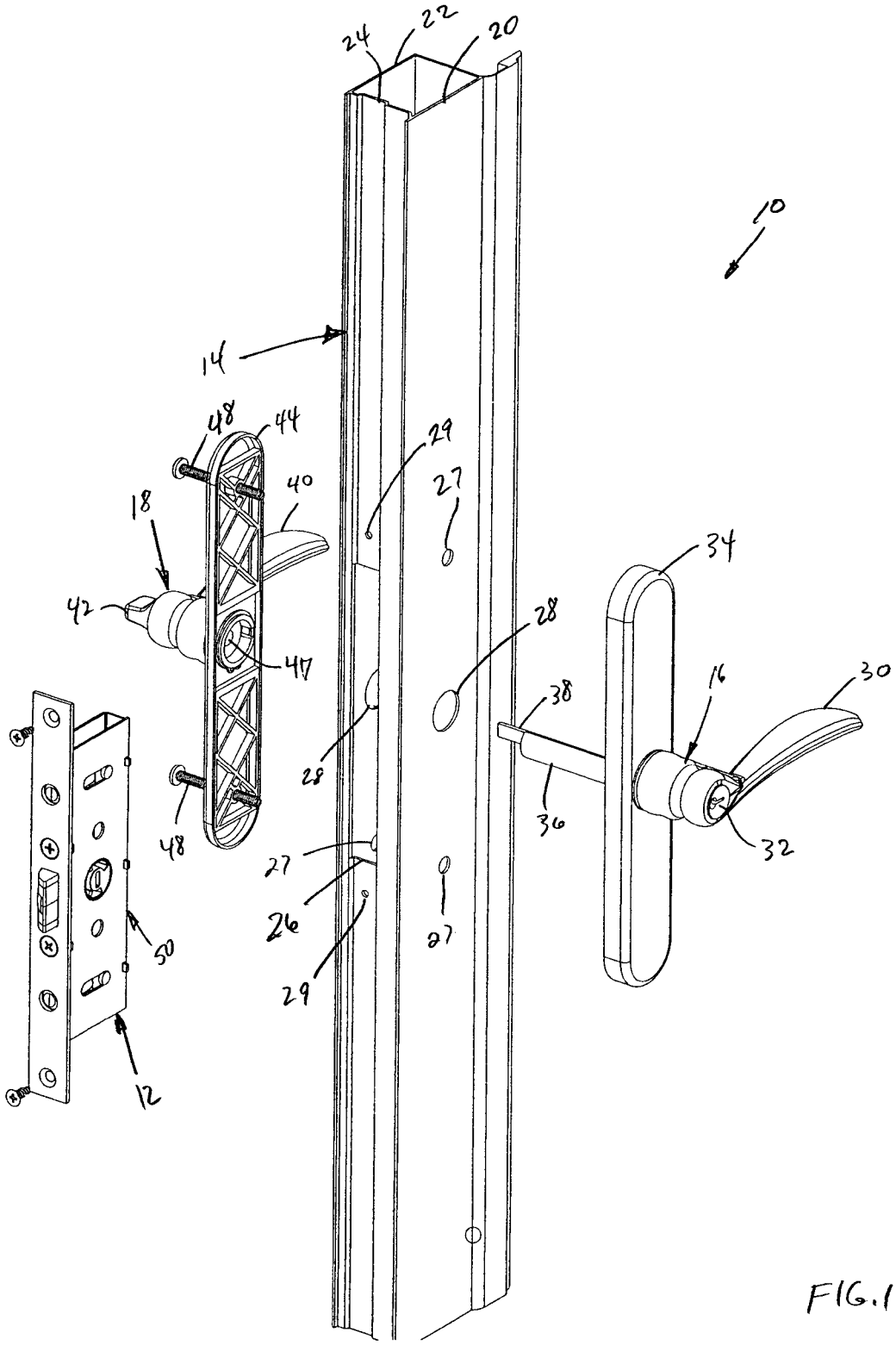
FIG. 1 is a partially exploded perspective view showing a first side of an example door assembly according to principles of the present invention, the door assembly including a mortise latch, a pair of handle assemblies, and a portion of a door structure.

While the invention is amenable to various modifications and alternative forms, the specifics thereof have been shown by way of example in the drawing and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE PREFERRED EMBODIMENT

The present invention generally relates to door assemblies and latch apparatuses. The invention more particularly relates to a mortise latch apparatus for use in a door panel such as a storm door. One aspect of the invention relates to a door assembly and method of assembling the door assembly in which the mortise latch is configured and arranged within the door panel so that the door panel can be reversible for use as a left hand door or a right hand door without altering an orientation of the mortise latch within the door panel. Another aspect of the invention relates to the mortise latch itself. The mortise latch may include a dual dead bolt configuration in which separate dead bolts are positioned symmetrically on opposing sides of the live bolt of the mortise latch. The dead bolts may be identical in size and shape. The dead bolts can be actuated between extended and retracted positions simultaneously. The mortise latch may include a connecting member within the latch housing wherein vertical movement of the connecting member within the housing creates horizontal movement of the dead bolt simultaneously between the extended and retracted positions.

A yet further aspect of the invention relates to a handle that may be used in conjunction with the door assembly. The door handle includes a lock mechanism. Rotation of the lock mechanism actuates the dead bolts between extended and retracted positions while rotation of the handle actuates the live bolt between extended and retracted positions. In some embodiments, the connecting member within the mortise latch may be used to lock the live bolt in an extended position when the dead bolts are also in the extended position.

Referring to FIGS. 1-8, an example door assembly 10 and various features of the door assembly are described and illustrated. The door assembly 10 includes a mortise latch 12, a door panel 14, and first and second handle assemblies 16, 18. The door panel 14 includes first and second opposing surfaces 20, 22, a face surface 24, a mortise 26 formed in the face surface 24, a handle bore 28 extending between the first and second surfaces 20, 22, and pair of fastener apertures 26, 29. The handle bore 28 and fastener apertures 27 may be used to secure the handle assemblies 16, 18 to the door panel 14. The mortise 26 and apertures 29 may be used to mount the mortise latch 12 to the door panel 14.

Figure 2:
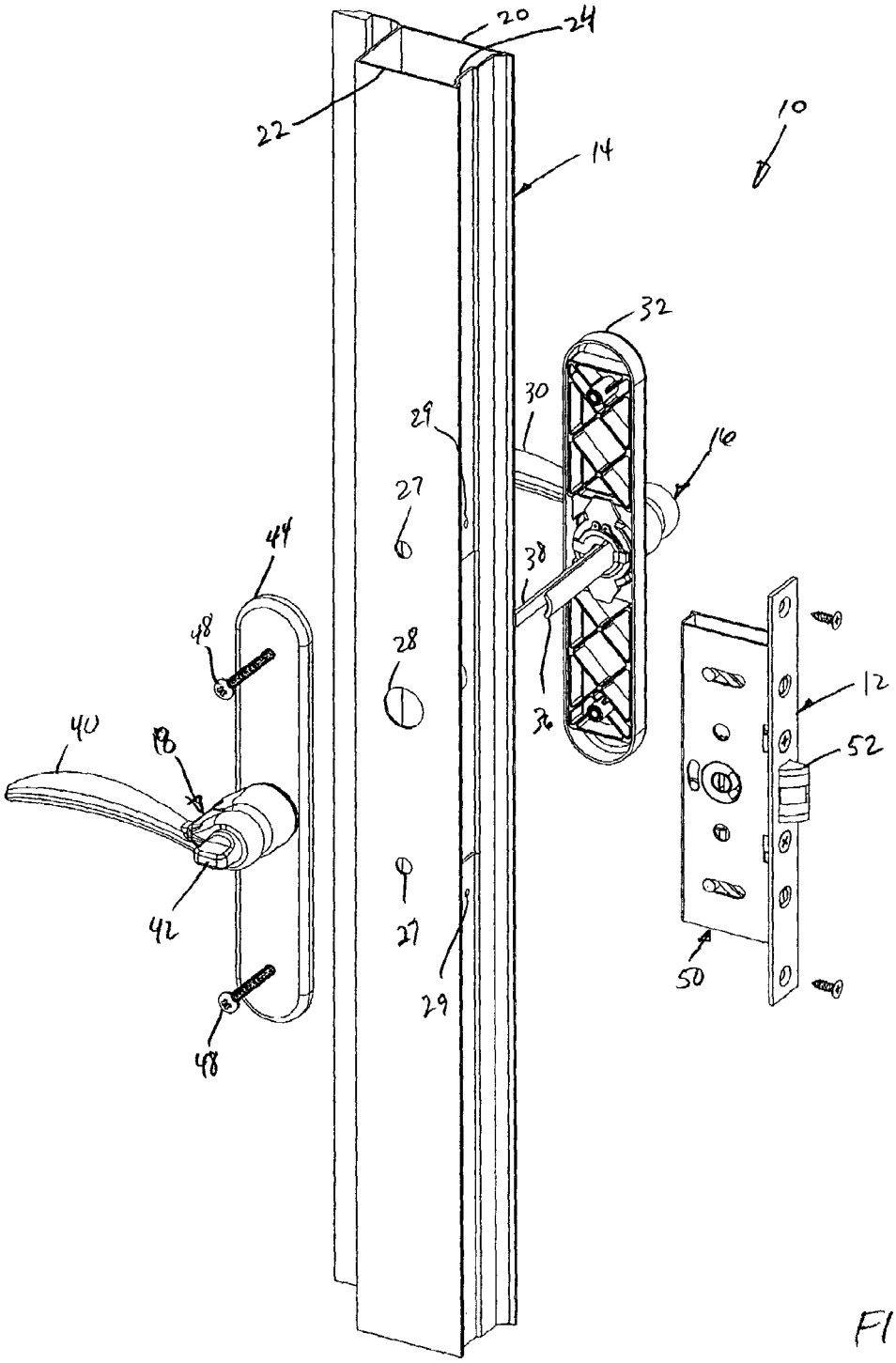
FIG. 2 is a partially exploded perspective view showing a second side of the door assembly shown in FIG. 1.
Figure 3:
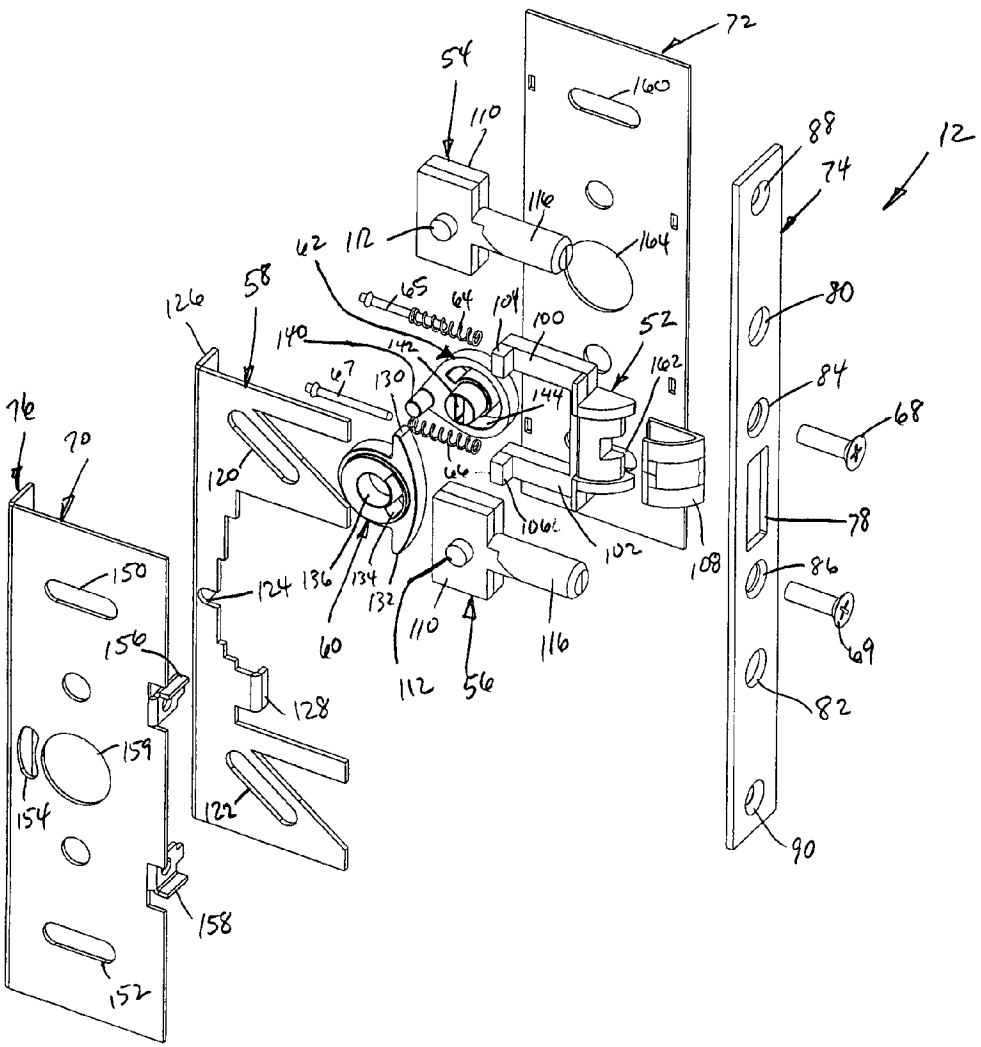
FIG. 3 is an exploded perspective view of the mortise latch as viewed from the second side shown in FIG. 2.
Figure 4:
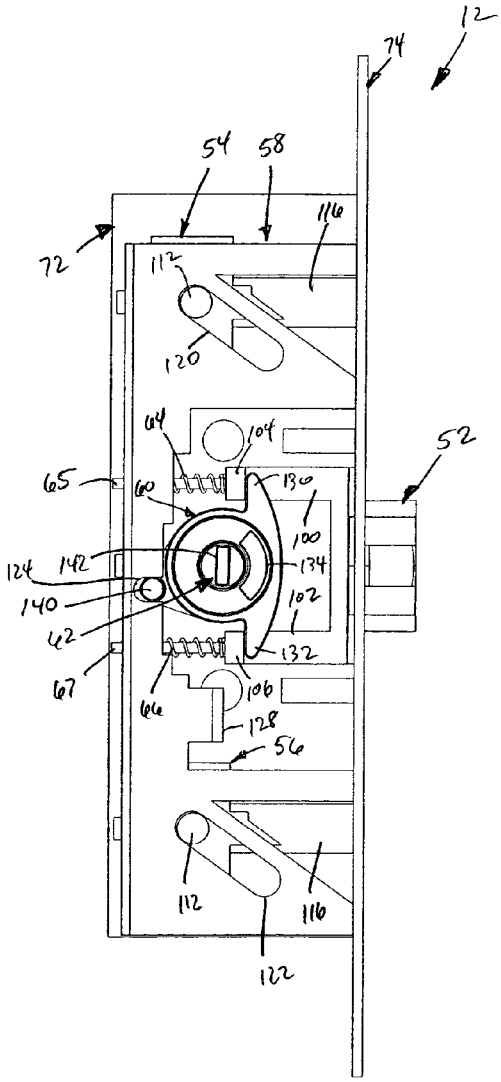
FIG. 4 is a side view of the mortise latch as viewed from the second side with a side plate of the mortise latch removed and the dead bolts in a retracted position.
Figure 5:
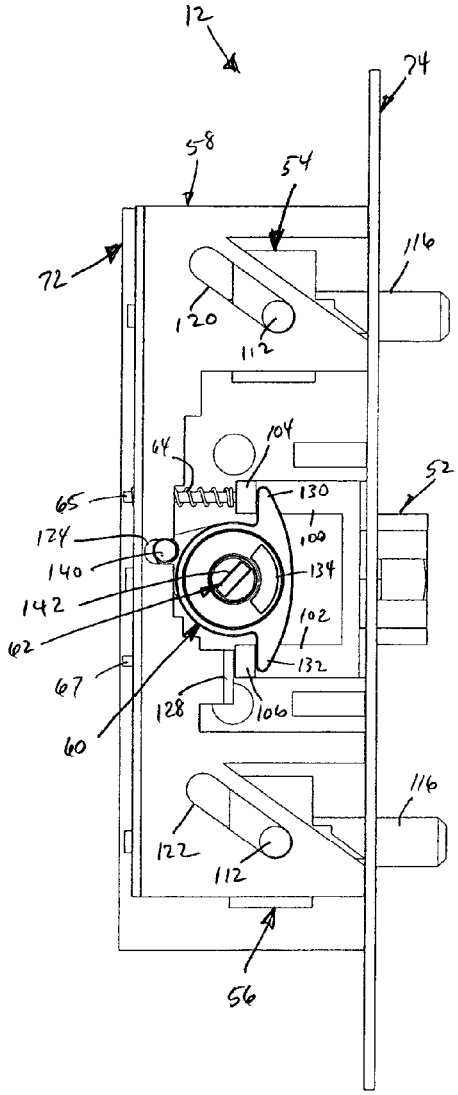
FIG. 5 is a side view of the mortise latch shown in FIG. 1 as viewed from the second side with a side plate of the mortise latch removed and the dead bolts in an extended position.
Figure 7:
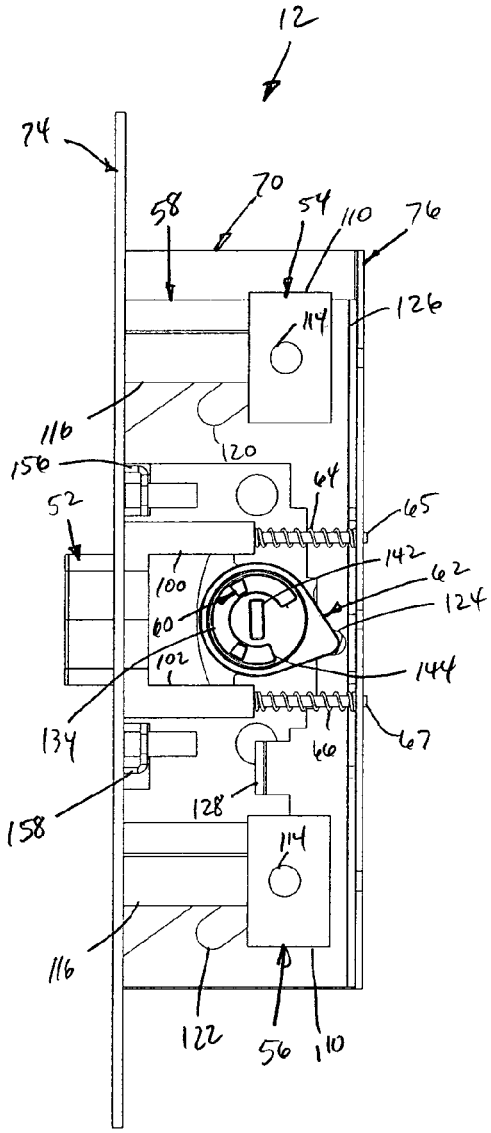
FIG. 7 is a side view of the mortise latch as viewed from the first side with a side plate of the mortise latch removed and the dead bolts in an extended position.

The door assembly 10 is configured so that the mortise latch 12 and handle assemblies 16, 18 can be assembled to the door panel 14 by the manufacturer and before shipping of the door assembly 10 to a retail store or to a building structure for installation by an installer. Preferably, the mortise 26 is formed equidistant between opposing top and bottom ends of the door panel 14. This arrangement of the mortise 26 provides the ability to turn the door panel 14 upside down for use as either a left hand or a right hand door. The bores and apertures 27-29 are all formed in the door panel 14 symmetrically spaced about the mortise 26 so that the mortise latch 12 and handle assemblies 16, 18 can be mounted to the door panel 14 as shown in FIGS. 1 and 2, with the mortise latch 12 turned upside down from the orientation shown in FIG. 2, or with the handle assemblies 16, 18 positioned on opposite sides of the door panel 14 from those shown in FIGS. 1 and 2.

The mortise latch 12 includes a dual dead bolt configuration in which two dead bolts are positioned symmetrically within the mortise 26 when the mortise latch 12 is mounted to the door panel 14. This symmetrical arrangement of the dead bolts makes it possible for the installer of the door to use the door assembly 10 as a right hand or left hand door without removing the mortise latch 12 from the mortise 26 and rotating an orientation of the mortise latch 180°. Several advantages result from this configuration related to both manufacturers and installers of the door assembly 10. One such advantage is that the manufacturer may be able to assemble the mortise latch 12 with the door panel 14 prior to shipping. With the latch assembled in the door, the door assembly 10 is ready for installation as either a right hand or left hand door prior to shipping the door assembly to a retailer or an installation location. Preassembly of the door assembly 10 can reduce overall costs for the installer who would otherwise have to purchase and install the mortise latch 12 separate from the door assembly 10. Preassembly of the door assembly 10 may also provide for easier, less complicated installation of the door assembly 10.

Figure 8:
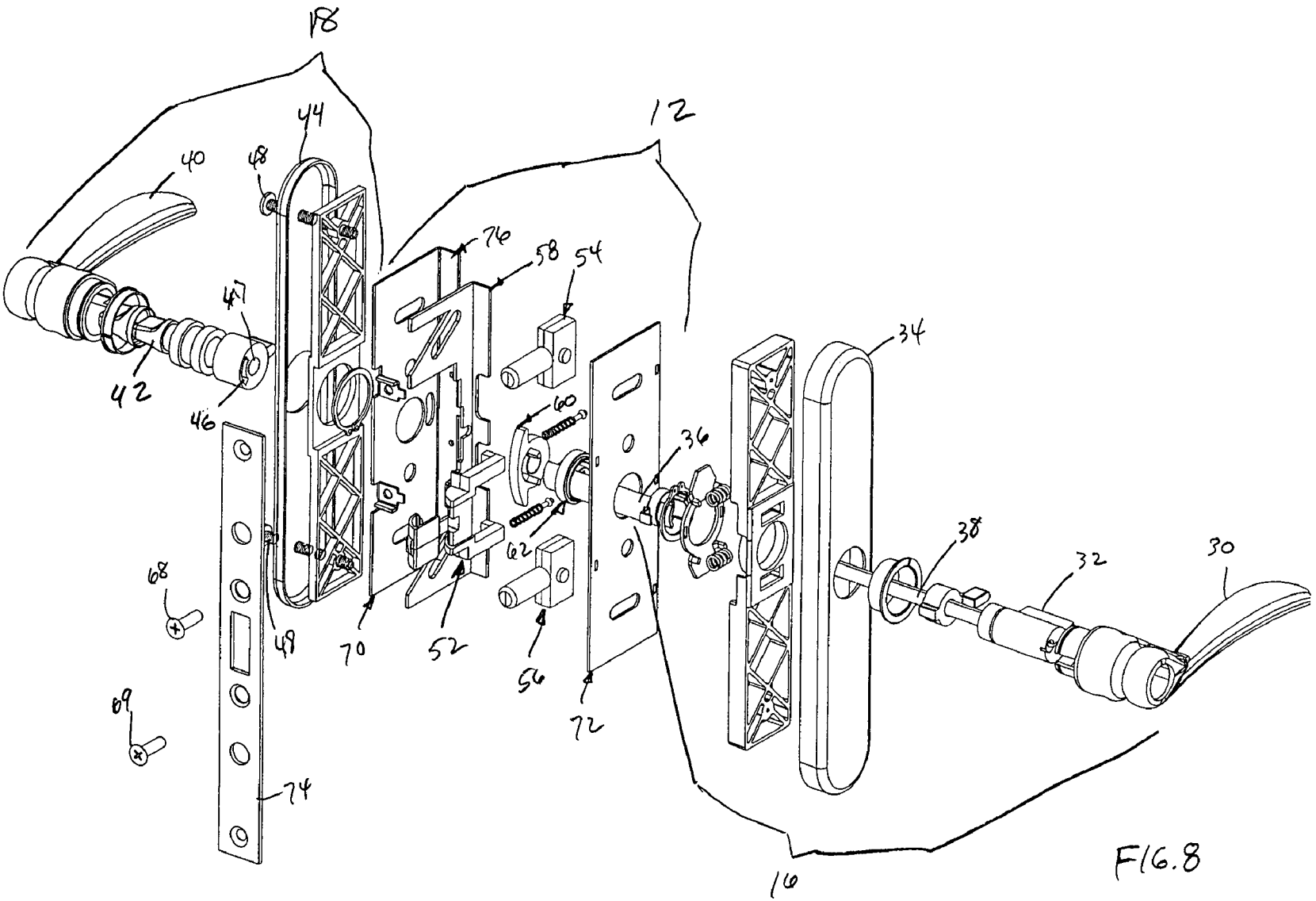
FIG. 8 is an exploded perspective view of the mortise latch and handle assemblies shown from the first side.

The first handle assembly 16 includes a first handle 30, a key lock mechanism 32, a first escutcheon plate 34, a handle spindle 36, and a lock spindle 38 (see FIG. 8 for further details). The handle spindle 36 is coupled to the handle 30 whereby rotation of the handle 30 also rotates the handle spindle 36. The lock spindle 38 is coupled to the lock mechanism 32 such that rotation of the lock mechanism via, for example, a key, results in rotation of the lock spindle 38. The spindles 36, 38 extend through the handle bore 28 and engage the second handle assembly 18.

The second handle assembly 18 includes a second handle 40, a thumb turn lock member 42, a second escutcheon plate 44, a handle spindle aperture 46 (see FIG. 8), a lock spindle aperture 47, and fasteners 48. When the handle assemblies 16, 18 are assembled with the door assembly 10, the thumb turn lock member 42 is coupled to the lock spindle 38 via the lock spindle aperture 47. Likewise, rotation of the handle 40 will rotate the handle spindle 36. As will be described in further detail below, rotation of the handle spindle 36 extends and retracts a live bolt of the mortise latch 12, while rotation of the lock spindle 38 extends and retracts the dead bolts of the mortise latch 12.

Referring now to FIGS. 3-7, the mortise latch 12 includes a housing 50 (see FIGS. 1 and 2), a live bolt 52, first and second dead bolts 54, 56, a lock slide 58, a live bolt hub 60, a slide hub member 62, and first and second biasing members 64, 66 supported by biasing supports 65, 67. A pair of fasteners 68, 69 may be used to retain the mortise latch 12 together as a single unit.

The housing 50 includes first and second side plates 70, 72, a face plate 74, and a rear plate 76. The rear plate 76 is integrally formed with the first plate 70 in this example, but may be a separate member in other embodiments.

The first side plate 70 includes first and second dead bolt tracks 150, 152, a hub follower track 154, first and second fastener mounts 156, 158, and a hub aperture 159. The dead bolt tracks 150, 152 retain a follower member (described below) of each of the dead bolts 54, 56. The hub follower track 154 retains a follower member (described below) of the slide hub member 62. The hub aperture 159 helps retain the live bolt hub 60. The fastener mounts 156, 158 preferably include a threaded aperture wherein the fasteners 68, 69 engage and retain the features of the mortise latch 12 together.

The second plate 72 includes first and second dead bolt tracks 160, 162 that retain separate follower members (described below) of each of the dead bolts 54, 56. A hub aperture 164 retains the slide hub member 62 in position within the housing 50.

The face plate 74 includes a live bolt aperture 78, first and second dead bolt apertures 80, 82, first and second housing fastener apertures 84, 86, and first and second door fastener apertures 88, 90. The dead bolt apertures 80, 82 are positioned symmetrically about the live bolt aperture 78 so as to ensure equal spacing of the dead bolts 54, 56 relative to the live bolt 52. The apertures 88, 90 receive fasteners used for securing the mortise latch 12 to the door panel 14 (see FIGS. 1 and 2).

The live bolt 52 includes first and second legs 100, 102 that include a hub contact 104, 106, respectively. The live bolt 52 may include a removable face 108 that includes, for example, a low friction material such as, for example, nylon. In other embodiments, the live bolt 52 may include a face plate or other type of structure that is integrally formed.

The dead bolts 54, 56 each include a base 110, first and second dead bolt followers 112, 114 positioned on opposing sides of the base 110, and a cylindrical post 116. The shape and size of a base 110, followers 112, 114, and post 116 may vary in other embodiments. For example, the post 116 may include a rectangular cross section or may have a variable size and shape cross section along a length of the post. The followers 112, 114 may also have different shapes and sizes so long as the followers provide tracking within the tracks 150, 152, 160, 162 of the first and second plates 70, 72. Preferably, the dead bolts 54, 56 are identical in shape and size, or at least the post portion 116 of each of the dead bolts is equivalent so as provide symmetry of the dead bolt structure extending from the face plate 74. A cylindrical post 116 may provide the advantage of improved ease in installing and manufacturing the door assembly 10. Typically, the dead bolt extends into an aperture formed in the door casing or frame within which the door assembly 14 resides. Forming a cylindrical shaped aperture in a door casing is typically easier to accomplish by an installer than forming a rectangular or other polygonal shape aperture.

The lock slide 58 includes first and second follower tracks 120, 122, a hub follower aperture 124, and offset member 126, and a live bolt locking member 128. The follower tracks 120, 122 are at least partially aligned with the follower tracks 150, 160 and 152, 162, respectively, of the side plates 70, 72. The follower tracks 120, 122 also help to retain the followers 112. The slanted orientation of the tracks 120, 122 relative to the tracks 150, 160 and 152, 162 results in translational (horizontal) movement of the dead bolts 54, 56 within the mortise latch 12 when the lock slide 58 moves vertically within the mortise latch 12.

The hub follower aperture 124 engages a portion of the slide hub member 62 (described below), wherein rotation of the slide hub member 62 results in the translational, vertical movement of the lock slide 58. The offset member 126 helps to space the lock slide 58 between the side plates 70, 72 and is shaped to accommodate movement of the lock slide 58 relative to the fixed position of the biasing members and biasing supports 64-67 that are acting upon the live bolt 52.

Figure 6:
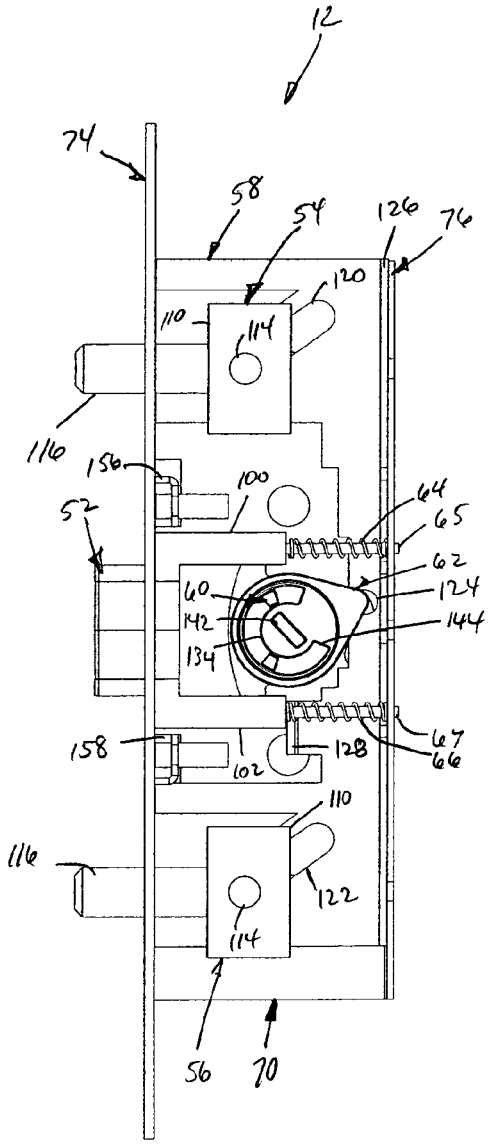
FIG. 6 is a side view of the mortise latch as viewed from the first side view shown in FIG. 1 with a side plate of the mortise latch removed and the dead bolts in a retracted position.

The live bolt locking member 128 is configured to engage with and disengage from the second leg 102 of the live bolt 52 during movement of the lock slide 58. When the lock slide 58 is in a first position (see FIG. 7) in which the dead bolts 54, 56 are in a retracted position, the live bolt locking member 128 is disengaged from the live bolt 52. However, when the lock slide 58 is in a second position in which the dead bolts 54, 56 are in an extended position (see FIG. 6) the locking member 128 is positioned in engagement with the leg 122 of the live bolt 52 so as to prevent retraction of the live bolt 52. In this way, movement of the lock slide 58 can effect and maintain a locked position of the dead bolts 54, 56 as well as an extended locked position of the live bolt 52. The hubs 60, 62 may be configured such that when the live bolt is locked in an extended position as shown in FIG. 6, the handles 30, 40 that are coupled to the live bolt 52 via the handle spindle 36 are also locked and prevented from rotating.

The live bolt hub 60 includes first and second actuators 130, 132, a handle spindle aperture 134, and a lock hub aperture 136. The actuators 130, 132 engage the hub contacts 104, 106 of the live bolt 52. The aperture 134 is configured to receive the handle spindle 36 that is coupled to the handles 30, 40. Rotation of the handles 30, 40 in either rotated direction will engage one or the other of the actuators 130, 132 against a respective hub contact 104, 106 to pull the live bolt 52 into a retracted position against biasing forces of the biasing members 64, 66. When the handles 30, 34 are released from a rotation force that is applied to those handles, the biasing members 64, 66 bias the live bolt 52 into the extended position, which rotates the live bolt hub 60 into a rest state corresponding to the handles 30, 40 extending to a rest state (e.g., the horizontal direction shown in FIGS. 1 and 2). The lock hub aperture 136 is configured such that the lock spindle 38 can extend there through and freely rotate within the live bolt hub 60 without rotating the live bolt hub.

The slide hub member 62 includes a slide follower 140, a lock spindle aperture 142, and a handle spindle track 144. The slide follower 140 engages the hub follower aperture 124 in the lock slide 58. Due to the radial spacing of the follower 140 for an axis of rotation of the slide hub member, which is aligned with the lock spindle aperture 142, rotation of the hub member 62 results in translational (vertical) movement of the lock slide 58 within the mortise latch 12.

The lock spindle aperture 142 is sized to receive the lock spindle 38 such that rotation of the lock spindle 38 causes rotation of the hub member 62. The handle spindle track 144 is sized with a greater track length than the handle spindle aperture 134 formed in the live bolt hub 60. This provides for rotation of the hub member 62 relative to the live bolt hub 60 without being actuated by the handle spindle 36 regardless of the rotated position of the live bolt hub 60. Thus, the live bolt hub 60 and slide hub member 62 can function independent of each other. Also, the spindles 36, 38 can actuate the respective live bolt hub 60 and slide hub member 62 while still providing passage of both spindles 36, 38 through both of the live bolt hubs 60 and slide hub member 62 for coupling of the handles 30, 40 to each other.

Figure 9:
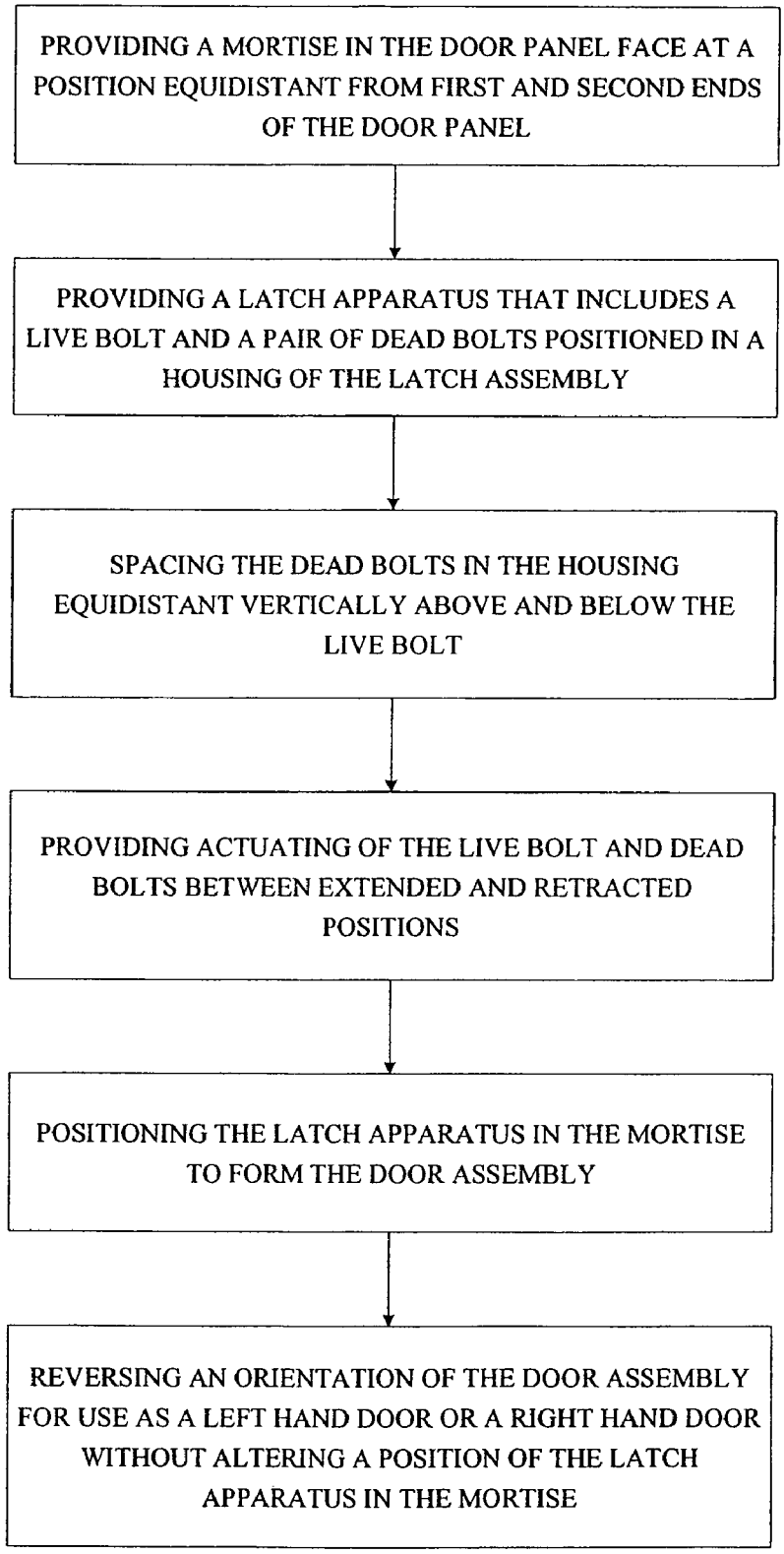
FIG. 9 is a flow chart illustrating steps of an example method according to principles of the present invention.

An example method of assembling a door assembly using features of the example door assembly 10 described above may include some of the example steps shown in the flow chart of FIG. 9. One step of the method includes providing a mortise in the door panel face wherein the mortise is equidistant from the first and second ends of the door panel. Another step of the method includes assembling the latch apparatus with a live bolt and a pair of dead bolts in a housing of the latch apparatus. Assembling the latch apparatus includes spacing the dead bolts in the housing equidistant vertically above and below the live bolt. The live bolt and dead bolts are actuated between extended and retracted positions. Another step of the method may include positioning the latch apparatus in the mortise to form the door assembly. This arrangement for a door assembly provides reversing of the door for use as a left hand door or a right hand door without altering a position of the latch apparatus in the mortise.

Another method related to the present invention is a method of actuating a locking function of a latch apparatus. The latch apparatus includes a live bolt and a pair of dead bolts wherein each of the dead bolts is positioned on opposing sides vertically above and below the live bolt. The latch apparatus also includes a live bolt hub that actuates the live bolt between extended and retracted positions and a slide hub member that actuates the dead bolts between extended and retracted positions. The live bolt hub and slide hub member are actuatable independent of each other. The method may include rotating the live bolt hub to actuate the live bolt between extended and retracted positions. Another step of the method may include rotating the slide hub member to simultaneously extend and retract the dead bolts. The latch apparatus may further include a lock slide that is coupled between the slide hub member and the dead bolts. Generally vertical movement of the lock slide within a housing of the latch apparatus results in generally horizontal movement of the dead bolts between the extended and retracted positions. The lock slide may include a live bolt locking member that retains the live bolt in an extended position when the lock slide actuates the dead bolts into the extended position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

I claim:

1. A latch apparatus, comprising:

a live bolt actuated between an extended position and a retracted position;

a first dead bolt positioned vertically above the live bolt and a second dead bolt positioned vertically below the live bolt, the first and second dead bolts having substantially the same size and shape and being spaced equidistant from the live bolt; and a slide coupling the first and second dead bolts to each other, wherein vertical movement of the slide simultaneously actuates the first and second dead bolts between extended and retracted positions; and a housing having opposed side plates and a face plate, wherein the side plates include first and second apertures aligned with the first and second dead bolts, and the first and second dead bolts each include a follower member received in the respective first and second apertures.

2. The latch apparatus of claim 1, further comprising a hub member rotatably mounted within the housing and coupled to the slide, wherein rotating the hub member moves the slide thereby extending and retracting the first and second dead bolts.

3. A latch apparatus, comprising:

a housing;

a live bolt mounted at least partially within the housing and actuated between an extended position and a retracted position, the live bolt biased into the extended position;

first and second dead bolts mounted at least partially within the housing at equally spaced apart positions on opposing sides of the live bolt and movable between retracted and extended positions;

a slide mounted within the housing, the slide coupling the first and second dead bolts to each other; and a hub member rotatably mounted within the housing and coupled to the slide, wherein rotating the hub member moves the slide thereby extending and retracting the first and second dead bolts independent of the live bolt;

a live bolt hub rotatably mounted within the housing in a coaxial arrangement with the hub member, wherein rotating the live bolt hub extends and retracts the live bolt independent of the hub member.

4. The latch of claim 3, wherein the live bolt and the first and second dead bolts are movable to extend out of the housing through a face plate of the housing.

5. The latch of claim 3, wherein first and second dead bolts have substantially the same size and shape.

6. The latch of claim 3, wherein the slide includes first and second slots associated with respective first and second dead bolts, and each of the dead bolts includes a follower that travels in the respective first and second slots.

7. The latch of claim 6, wherein the slots are formed at an angle relative to a direction of motion of the slide.

8. The latch of claim 3, further comprising a handle, and a handle spindle, the handle spindle being coupled between the live bolt hub and the handle, wherein rotating the handle rotates the live bolt hub thereby extending and retracting the live bolt.

9. The latch of claim 3, further comprising a handle, a lock mechanism mounted in the handle, and a lock spindle, the lock spindle coupling the lock mechanism to the hub member, wherein actuating the lock mechanism rotates the hub member independent of the live bolt.

10. The latch of claim 3, wherein the slide includes a live bolt locking member, the live bolt locking member being configured to lock the live bolt in an extended position when the slide is moved into a position wherein the first and second dead bolts are in the extended position.

11. The latch of claim 10, wherein the slide includes a plate portion and the live bolt locking member extends from the plate portion in a direction substantially normal to a primary surface of the plate portion.

12. The latch of claim 3, wherein the housing includes a face plate and spaced apart side plates, at least one of the side plates including a side plate slot sized to receive a follower member extending from at least one of the first and second dead bolts.

13. The latch of claim 12, wherein the slide defines first and second slide slot, the first slide slot configured to receive a follower member extending from the first dead bolt, and the second slide slot configured to receive a follower member extending from the second dead bolt, at least one of the first and second slide slots being positioned to intersect with the side plate slot formed in the at least one side plate such that the follower member received in the first or second slide slots extends into the side plate slot.

14. The latch of claim 3, further comprising a biasing member configured to bias the live bolt into the extended position.

15. The latch of claim 3, wherein the live bolt moves independent of the slide, and the first and second dead bolts.

16. A door, comprising:

a door panel including a mortise formed in a face surface thereof and a bore extending between opposed side surfaces thereof;

a handle assembly including a handle member and a locking mechanism included within the handle member, the included locking mechanism being operable independent of the handle member in which the locking mechanism is included; and a latch apparatus disposed in the mortise, the latch apparatus comprising:

a live bolt movable between extended and retracted positions, the live bolt biased into the extended position;

first and second dead bolts positioned at opposing sides of the live bolt and movable between extended and retracted positions; and a slide coupled to the first and second dead bolts and to the locking mechanism;

wherein the included locking mechanism actuates the slide to extend and retract the first and second dead bolts, and the handle member actuates the live bolt between extended and retracted positions independent of the first and second dead bolts, and wherein the included locking mechanism acts to both extend and retract the first and second dead bolts.

17. The door of claim 16, wherein the mortise is formed equidistant from top and bottom ends of the door panel, and the latch apparatus includes a symmetrical orientation of the live bolt and the first and second dead bolts relative to the mortise.

18. A door, comprising:

a door panel including a mortise formed in a face surface thereof and a bore extending between opposed side surfaces thereof;

a handle assembly including a handle member and a locking mechanism; and a latch apparatus disposed in the mortise, the latch apparatus comprising:

a live bolt movable between extended and retracted positions, the live bolt biased into the extended position;

first and second dead bolts positioned at opposing sides of the live bolt and movable between extended and retracted positions; and a slide coupled to the first and second dead bolts and to the locking mechanism;

wherein the locking mechanism actuates the slide to extend and retract the first and second dead bolts, and the handle member actuates the live bolt between extended and retracted positions independent of the first and second dead bolts, and wherein the latch apparatus further includes a rotatable hub member coupled to the slide and a live bolt hub coupled to the live bolt and arranged coaxial with the hub member, and rotating the locking mechanism rotates the hub member thereby actuating the slide to move the first and second dead bolts, and rotating the handle moves the live bolt between the extended and retracted positions.

19. A latch apparatus, comprising:

a housing;

a live bolt mounted at least partially within the housing and actuated between an extended position and a retracted position;

first and second dead bolts mounted at least partially within the housing at equally spaced apart positions on opposing sides of the live bolt and movable between the retracted and extended positions;

a slide mounted within the housing, the slide coupling the first and second dead bolts to each other; and a hub member rotatably mounted within the housing and coupled to the slide, wherein rotating the hub member moves the slide thereby extending and retracting the first and second dead bolts;

wherein the slide includes a plate portion and a live bolt locking member, the live bolt locking member extending from the plate portion in a direction substantially normal to a primary surface of the plate portion, the live bolt locking member being configured to lock the live bolt in an extended position when the slide is moved into a position wherein the first and second dead bolts are in the extended position.

* * * * *